US009080265B2

(12) United States Patent
He et al.

(10) Patent No.: US 9,080,265 B2
(45) Date of Patent: Jul. 14, 2015

(54) FABRIC STRAP WITH SOFT SIDE EDGES

(71) Applicant: New Horizon Elastic Fabric Co., Ltd, Dongguan (CN)

(72) Inventors: Mike He, Dongguan (CN); Rhett Dong, Dongguan (CN)

( * ) Notice: Subject to any disclaimer, the term of this patent is extended or adjusted under 35 U.S.C. 154(b) by 0 days.

(21) Appl. No.: 14/055,871

(22) Filed: Oct. 16, 2013

(65) Prior Publication Data

US 2014/0174586 A1 Jun. 26, 2014

(30) Foreign Application Priority Data

Nov. 19, 2012 (EP) ..... 12193134

(51) Int. Cl.

| | |
|---|---|
| ***D03D 5/00*** | (2006.01) |
| ***D03D 15/08*** | (2006.01) |
| ***D03D 3/00*** | (2006.01) |
| *D03D 25/00* | (2006.01) |

(52) U.S. Cl.

CPC ..... *D03D 15/08* (2013.01); *D03D 3/005* (2013.01); *D03D 5/00* (2013.01)

(58) Field of Classification Search

CPC ... D02G 3/328; D02G 1/0286; D02G 1/0266; D02G 3/28; D02G 3/36; D02G 1/165; D02G 3/22; D02G 3/286; D02G 3/32; D02G 3/38; D03D 15/08; D03D 5/00; D03D 15/00; D03D 15/0027; D03D 15/0094; D03D 1/0005; D03D 1/0094; D03D 3/02; D03D 47/44; D10B 2331/10; D10B 2401/061

See application file for complete search history.

(56) References Cited

U.S. PATENT DOCUMENTS

| | | | | | |
|---|---|---|---|---|---|
| 3,315,328 | A | * | 4/1967 | Salim | 28/156 |
| 3,365,875 | A | * | 1/1968 | Hall | 57/226 |
| 3,540,204 | A | * | 11/1970 | Toshimoto et al. | 57/6 |
| 3,577,873 | A | * | 5/1971 | Waters | 57/205 |
| 3,596,458 | A | * | 8/1971 | Nakano et al. | 57/2 |
| 3,691,750 | A | * | 9/1972 | Waters | 57/205 |
| 3,763,640 | A | * | 10/1973 | Nagel et al. | 57/6 |
| 3,807,162 | A | * | 4/1974 | Tsujita et al. | 57/205 |
| 3,844,103 | A | * | 10/1974 | Sasaki et al. | 57/2 |
| 3,991,548 | A | * | 11/1976 | Toronyi et al. | 57/205 |
| 4,307,565 | A | * | 12/1981 | Sasaki et al. | 57/205 |
| 4,351,147 | A | * | 9/1982 | Blackmon et al. | 57/208 |
| 4,554,121 | A | * | 11/1985 | Kramers | 264/103 |
| 4,600,626 | A | * | 7/1986 | Ogata | 428/193 |
| 4,750,529 | A | * | 6/1988 | Watanabe | 139/383 R |
| 5,008,992 | A | * | 4/1991 | Gehrmann et al. | 28/271 |
| 5,014,404 | A | * | 5/1991 | Smith | 28/271 |
| 5,237,808 | A | * | 8/1993 | Gordon, Jr. | 57/288 |
| 5,313,776 | A | * | 5/1994 | Humbrecht et al. | 57/287 |
| 5,417,046 | A | * | 5/1995 | Setzer | 57/6 |
| 5,481,861 | A | * | 1/1996 | Frith | 57/288 |

(Continued)

*Primary Examiner* — Bobby Muromoto, Jr.

(74) *Attorney, Agent, or Firm* — George G. Wang; Bei & Ocean

(57) ABSTRACT

Integrally woven fabric strap having a soft edge on one or both longitudinal sides. The soft edge of the strap comprises spandex covered warp yarns which are thinner than the counterpart warps in the main body of the strap and also has a less dense weaving pattern for reducing weft exposure on the edge warp. Both these technical features contribute to the effect of softness and smoothness of the side edges. With the soft edge, the strap of this invention can find various applications in the underwear industry, as it causes no discomfort despite it is in close contact with the skin and has frequent movement causing frictions thereon during the course of daily wearing.

5 Claims, 8 Drawing Sheets

(56) References Cited

U.S. PATENT DOCUMENTS

| | | | | | |
|---|---|---|---|---|---|
| 5,560,192 | A * | 10/1996 | Frith | 57/226 |
| 5,823,014 | A * | 10/1998 | Kobayashi et al. | 66/178 R |
| 5,931,023 | A * | 8/1999 | Brach et al. | 66/136 |
| 6,105,224 | A * | 8/2000 | O'Mara et al. | 28/271 |
| 6,880,212 | B2 * | 4/2005 | Bakker et al. | 28/271 |
| 8,317,568 | B2 * | 11/2012 | He | 450/41 |
| 8,528,310 | B2 * | 9/2013 | Ganahl et al. | 57/282 |
| 2011/0104986 | A1 * | 5/2011 | He | 450/93 |
| 2011/0137384 | A1 * | 6/2011 | Chen | 607/88 |
| 2011/0151155 | A1 * | 6/2011 | He | 428/34.1 |
| 2011/0237158 | A1 * | 9/2011 | He | 450/43 |
| 2014/0110015 | A1 * | 4/2014 | He | 139/387 R |
| 2014/0174586 | A1 * | 6/2014 | He et al. | 139/421 |

* cited by examiner

FABRIC STRAP WITH SOFT SIDE EDGES

CROSS-REFERENCE TO RELATED APPLICATIONS

This application claims foreign priority from European Patent Application No. EP2594670, filed Nov. 19, 2012.

FIELD OF THE INVENTION

The present invention relates to the field of fabricating fabric straps used in the garment industry. More particularly, it relates to a fabric strap with soft longitudinal side edges for improved comfortableness when coming in contact with the skin of a user.

BACKGROUND OF THE INVENTION

The fabric strap is a widely used article in daily life, particularly in the garment industry. Conventionally, the weft yarn at the place where it turns around on the side warp or lock yarn is exposed and is in contact with the skin of the user, which can create a very coarse feel to the skin, particularly when the strap uses thicker spandex covered yarns as the warps for purposes of increasing the thickness and strength or making any attached side laces straight, not prone to rolling back. To overcome this problem, one common method in the art is to use an additional piece of cloth to cover around the strap's edge. However, this complicated process lowers production efficiency and hinders automation of the manufacturing process. Another method is disclosed in Chinese Pat. No. 200510036729.5, issued to Pioneer Elastic Fabric Ltd. (China). In this method, the fabric strap was designed to contain yarns of low-melting point along each of the side edges. Before subject to a heat-treating process with an ironing equipment, the edge is folded along an imaginative longitudinal line onto the strap itself and the low-melting point material of the edge melts and sticks to the surface upon which the edge was folded during the heat treatment, resulting a two-layer laminated structure along each edge. After this folding and laminating process, the actual coarse fabric edge is no longer at the edge of the resulting fabric but is folded towards the middle of the strap and will not be in contact with the skin. The new edge of the strap is formed along the folding line, which is soft and smooth. While this method realizes the effect of softening the edges of the strap, it suffers the drawbacks of high production costs with a complicated manufacturing process.

SUMMARY OF THE INVENTION

In view of the above mentioned problems in the art, one object of the present invention is accordingly to provide a type of fabric strap with soft edges produced with a simpler manufacturing process, which is conducive to industrial automation. Within this novel fabric strap, one of both longitudinal sides are of a soft edge which is composed of thinner spandex covered yarns than other parts of the strap and has less weft yarns exposed at the edge. The fabric strap made with a conventional weaving technology is illustrated in FIG. 1. The spandex covered warps 101 in the main body of the strap are thick, which is necessary to provide sufficient strength, particular when used as shoulder straps for sustain women's cleavage, or as used in the girdle or the corset where the strap must be strong. With the existing weaving technology, as shown in FIG. 1, the thickness of spandex covered warp yarns for the edges are as thick as those for the main body of the strap, which makes the edges feel significantly coarse. Furthermore, the weaving pattern of the weft yarn on the spandex covered warp yarn at the edge is usually 1+1− (one over and one under), 2+2− (two over and two under), or the weft yarns completely covering the warp yarn, which are all very dense weaving structures. With those dense weaving structures, there are more intercrossing of the weft 103 on the warp at the side edge, shorter warp floats, and more weft exposed over the spandex-covered warp at the edge. Those are factors contributing to the feel of coarse, scratching, irritating on the skin. In contrast, as shown in FIG. 2, with the weaving technology of the present invention, the strap has much thinner spandex-covered warp yarns 105 in the edge compared to the ones 101 in the main body and a much loosen weaving structure at the edge, such as, for example, 3+1− (three over and one under) in two strands, 3−1+ (three under and one over) in two strands, 5+1− (five over and one under) in three strands, etc. This reduces the number of weft crossing over the edge warp and results in longer warp floats covering the weft and reducing its exposure. Thus, with the weaving technology of the present invention, the comfortable feel of the fabric strap's edge will not be deteriorated even with thicker straps (requiring thicker warp yarns) or straps with stronger edge laces on the other side edge (requiring thicker weft yarns).

DETAILED DESCRIPTION OF PARTICULAR EMBODIMENTS OF THE INVENTION

Figure 1:
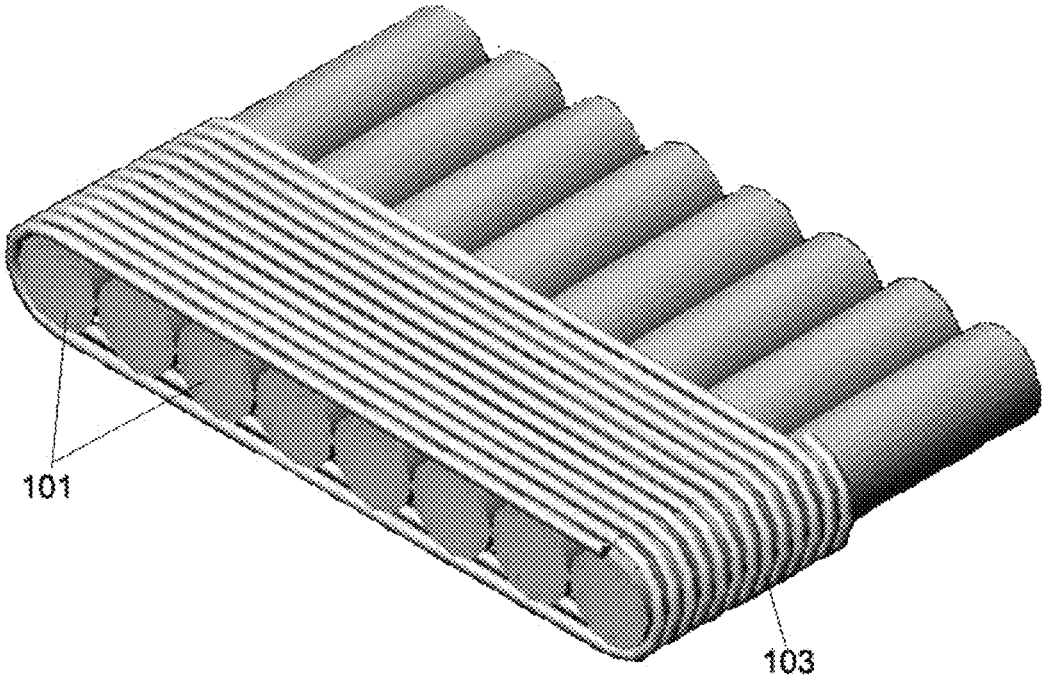
FIG. 1 is a diagram illustrating the structure of a fabric strap woven with conventional existing methods in the prior art.
Figure 2:
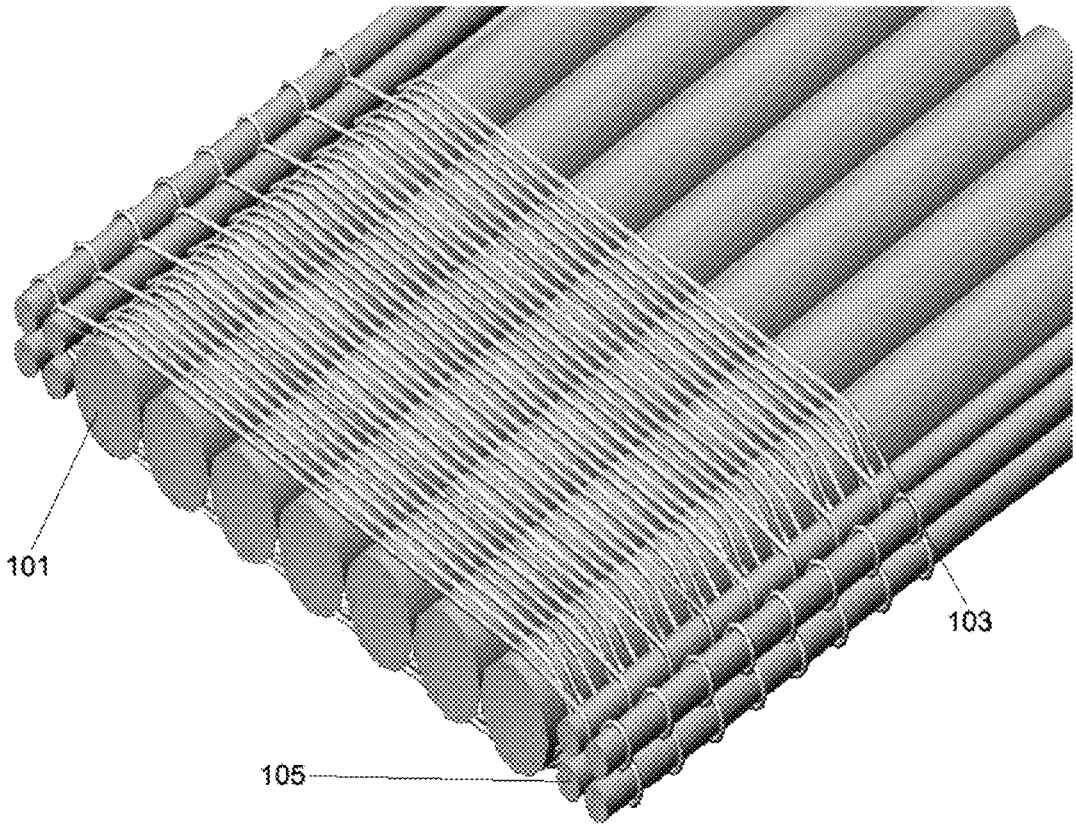
FIG. 2 is a diagram illustrating the structure of a fabric strap woven with the method of the present invention for the purpose of contrasting it with the prior art structure shown in FIG. 1.

The invention will be further illustrated with the aid of schematic drawings (it is understood that drawings are schematic in nature solely for illustrating the principles of the present invention and as such they may not be very accurate, for example, in terms of the number and size of the yarns depicted in the drawings). For the embodiments described in the following, the weaving equipment used is an electronic shuttleless loom, provided by Muller of Swiss.

Figure 4:
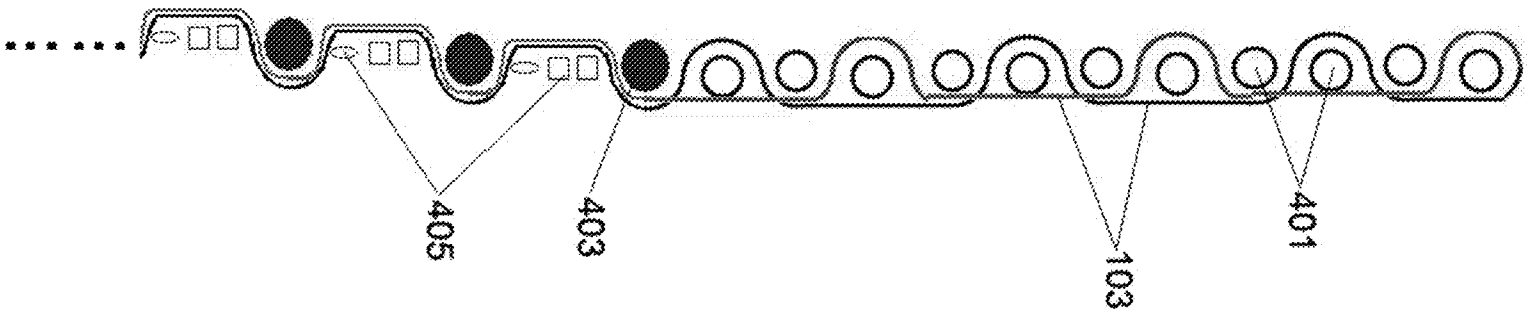
FIG. 4 is a schematic sectional view of the soft-edged fabric strap in FIG. 2 along the A-B line.

EXAMPLE I (1) Warping Preparation: The warps include: spandex covered yarns for soft edges (●), 78 dtex spandex, 18 ends;

spandex covered yarn for the framework ○, 1240 dtex spandex, 16 ends; surface yarn ×, 110/24 SD Nylon, 90 ends; flocked yarn Δ 78/24/2 SD Nylon, 33 ends; yarn linking the upper layer and the lower layer ▲, 78/18 SD Nylon, 30 ends; yarn linking the strap's main body and the soft edge ⊠, 44/12/2 SD Nylon, 4 ends. All the warp yarns are undergoing the beam-warping and head material preparation steps. Part of the warp arrangement order is shown in FIG. 4, where 401 is spandex covered warp yarns in the edge, 103 is weft, 403 is spandex covered warp yarns in the main body, and 405 is other warp yarns in the main body.

Figure 5A:
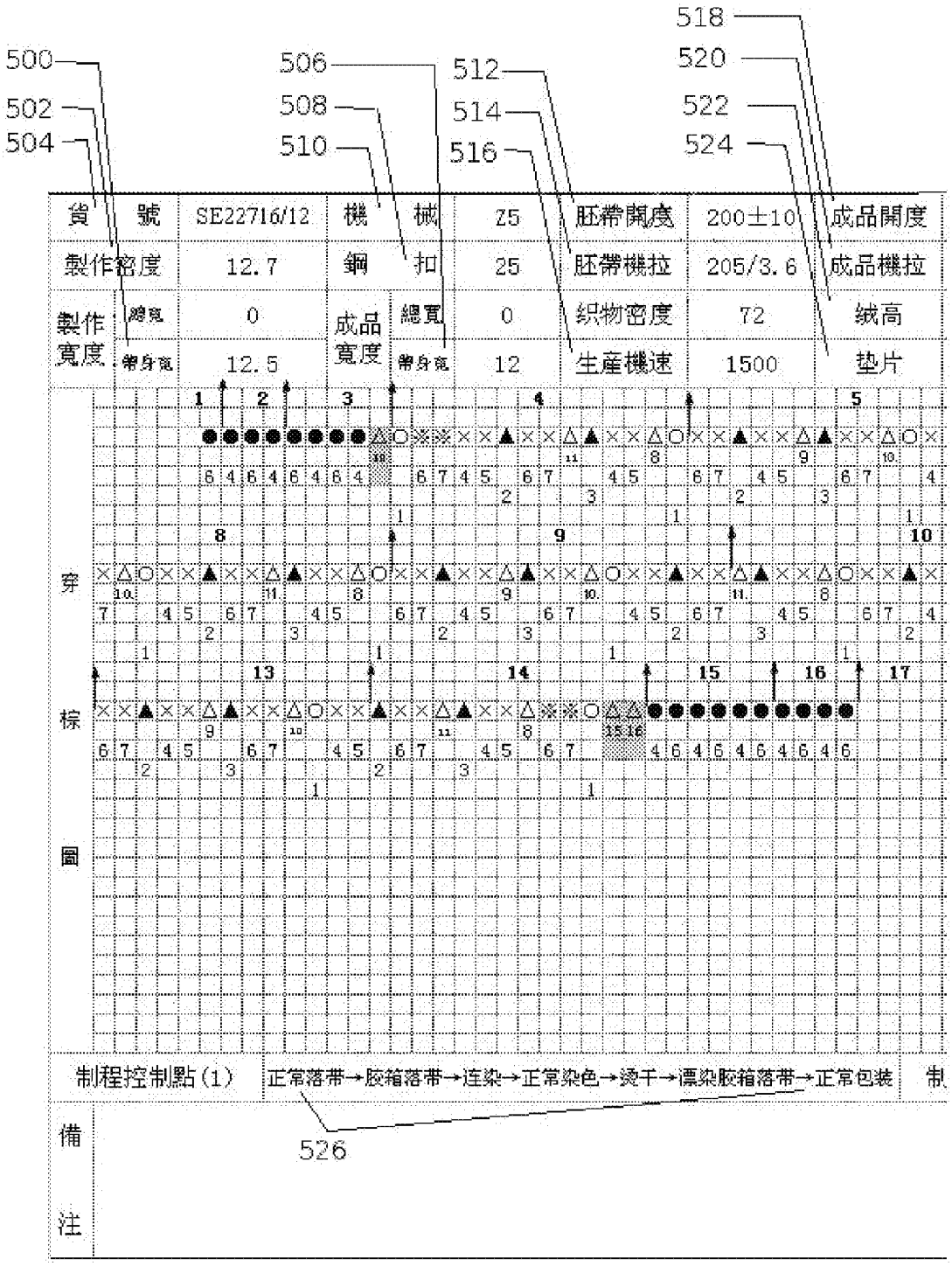
FIG. 5 is the actual drafting plan used for producing the fabric strap of the present invention described in the first example of the specification.
Figure 5B:
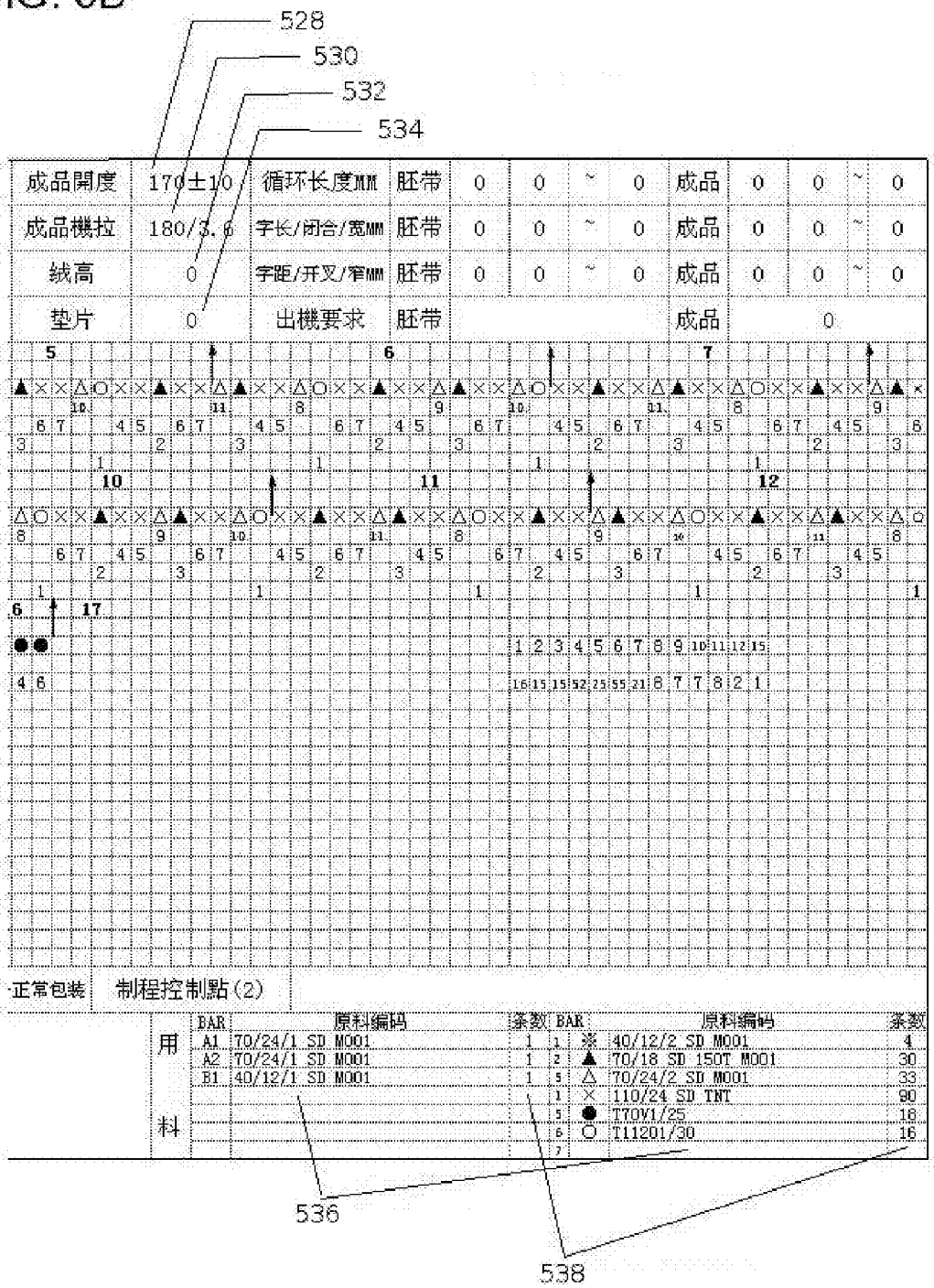

(2) Drafting: Pass each warp through the eye of the heddle according to the warp arrangement order according to the drafting plan shown in FIG. 5.

(3) Weft density: The weft density of strap of this example is 12.7 picks/centimeter.

(4) Width and Reed: The width of the finished product is 12 mm (millimeters), that is 25 grids per inch. Thread the warp yarn into each grid of the steel reed according to the threading order shown in the drafting plan in FIG. 5 (500—width of unfinished (embryotic) strap, 502—weft density, 504—product No., 506—width of finished strap, 508—reed grid number, 510—loom machine model, 512—stretchability of unfinished product, 514—stretchability by machine of unfinished product, 516—machine speed; 518, 528—stretchability of finished product, 520, 530—stretchability by machine of finished product, 522, 524, 532, 534—"O" refers to the parameters that are not applicable to this product, 526—refers to the parameters that are of the standard procedure, 536—yarn material code, and 538—number of yarns).

(5) Weft yarns and lock yarns: Both the upper weft yarn and the lower weft yarn are 78/24/1 SD Nylon; the lock yarn is 44/12/1 SD Nylon.

Figure 6:
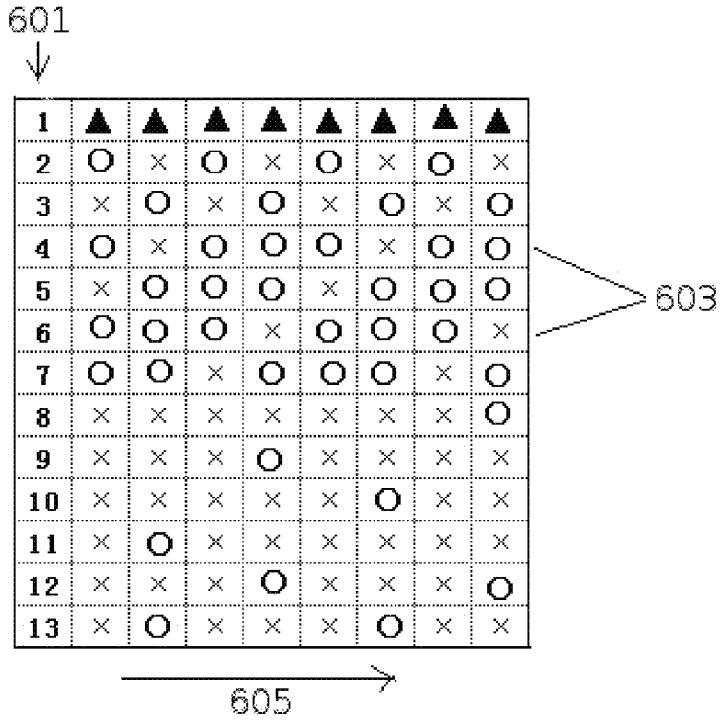
FIG. 6 is the actual weaving diagram used for producing the fabric strap of the present invention described in the first example of the specification.

(6) Loom weaving patterns: As shown in FIG. 6, the weaving pattern of the yarns for the soft-edge (78 dtex spandex) is 3+1− (three over and one under) in two strands. The weaving pattern of the yarns for the framework (1240 dtex spandex) is that all the yarns are in the middle. The weaving pattern of the surface yarns (110/24 SD Nylon) is 3−1+ in four strands (three under and one over). The weaving pattern of the flocked yarns (78/24/2 SD Nylon) is 7+1− (seven over and one under) in two strands. The weaving pattern of the yarns linking the upper layer and the lower layer (78/18 SD Nylon) is 1+1− (one over and one under) in two strands. The weaving pattern of the yarns linking the main body and the soft edge (44/12/2 SD Nylon) is the same as the weaving pattern of the surface yarns (110/24 SD Nylon). The heald frame drives the harness wires to move vertically according to an appropriate weave diagram (shown in FIG. 6), dividing the warp yarns into upward and downward layers to form an opening (shed), through which the weft yarn (pick) is to be inserted. In FIG. 6, 601 refers to order No. of heald frames, 603 refers to the heald frames (nos. 4 and 6) corresponding to warps in the edge, and 605 refers to a weft repeating unit.

(7) Weft insertion and beating: The upper and lower weft yarns (78/24/1 SD Nylon) are passed through the upper weft yarn hook and the lower weft yarn hook, respectively. The hooks bring the weft yarns passing through the shed and the side lock yarns (44/12/1 SD Nylon) are then taken by the tongues of the hooks. The steel reed swings back and forth, beating the weft yarns which has just passed through the shed and resulting in the strap being formed.

(8) Rolling: A rubber roller on the loom rolls up the newly formed strap. The rolling speed is adjustable by a density adjustment device on the loom machine.

(9) Post-weaving process: The newly fabricated strap further undergoes the dyeing step according to a predetermined coloring requirement.

The references of the symbols in FIG. 6 are: × for the warp yarn is at the higher position; ▲ for the warp yarn is at the middle position; ○ for the warp yarn at the lower position. It should be understood that the weaving patterns suitable for making the soft-edged strap of the present invention are not confined to those shown in FIG. 6. In fact, the main body of the strap of the present invention can be of any weaving patterns deemed proper in the art, while the weaving pattern of the soft-edges may be, for example, 3+1− in two strands (three over and one under), 3−1+ in two strands (three under and one over), 5+1− in three strands (five over and one under), 5−1+ in three strands (fiver under and one over), 3+1−3−1+ in four strands (three over, one under, three under and one over), 3+1−3−1= in four strands (three over, one under, three under and one middle), or any other structures deemed similar to the aforementioned weaving patterns in the art (+ refers to the upper position, − refers to the lower position, and = refers to the middle position).

The outer surface of the main body of the strap can be villous or non-villous. The main body of the strap can be made of chinlon, spandex, cotton yarn, dacron, or other materials. If the outer surface is to be made of villous, chinlon should be chosen as it can produce a better effect. The specification, such as the number and thickness, of the material yarns suitable for the main body are not limited to the above described, but can be determined according to particular requirements such as, for example, thickness, open degree, strength, width, etc. The number and thickness of the spandex-covered yarns suitable for the soft-edge should be chosen according to the stability requirement of the strap but are otherwise unlimited as long as they are, compared to the spandex-covered yarns in the main body, thinner to a degree sufficient for producing the soft and smooth effect for the edges.

The main body of the fabric strap of the present invention can be elastic or non-elastic, which can be made with materials of higher elastic coefficient or near-zero elastic coefficient, respectively.

The weaving pattern of the main body of the strap is not limited to any specific patterns and thus forms no part of the present invention. Laces can be added to the strap according to the needs under specific situations.

The fabric density of the main body of the strap may be predetermined according to the demand of elongation and the particular weaving patterns employed.

EXAMPLE II

Figure 3:
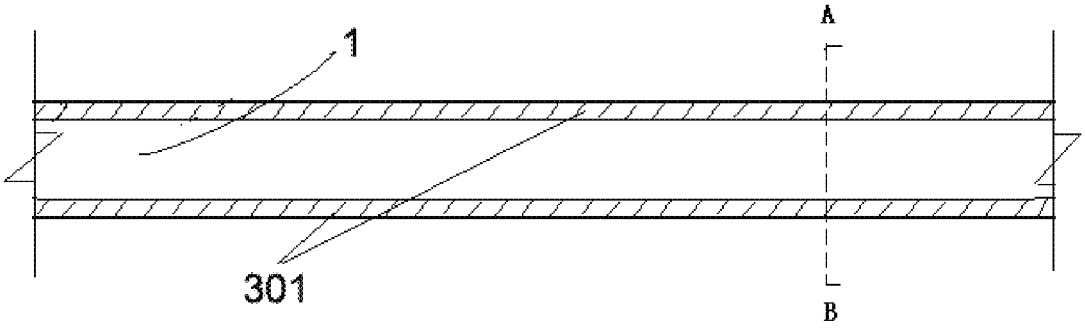
FIG. 3 is a schematic top view of the soft-edged fabric strap of the present invention.
Figure 7:
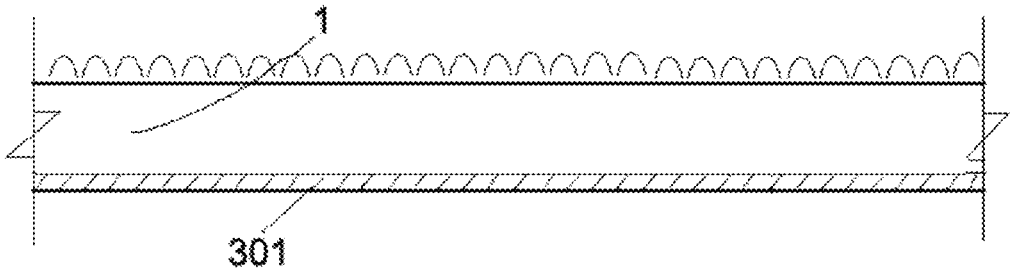
FIG. 7 is a schematic illustration of a fabric strap of the present invention with a soft edge on one longitudinal side while the other side is attached with a lantern lace.
Figure 8:
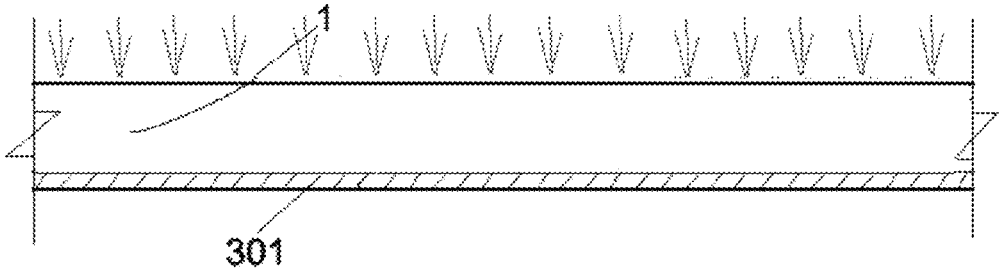
FIG. 8 is a schematic illustration of a fabric strap of the present invention with a soft edge on one longitudinal side while the other side is attached with a crown lace.
Figure 9:
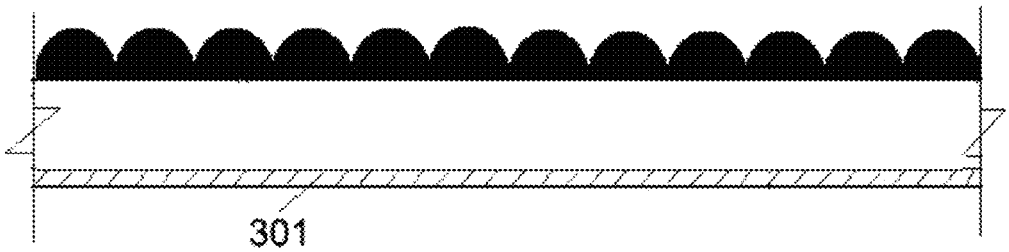
FIG. 9 is a schematic illustration of a fabric strap of the present invention with a soft edge on one longitudinal side while the other side is attached with a wave lace.

In contrast with the embodiment described above and illustrated in FIG. 3, where the main body 1 of the strap is flanked with two soft longitudinal edges 301, the fabric strap of the present invention may have one longitudinal side edge that is of the above-described weaving pattern for producing the soft-touch feel effect while its other side edge is of a conventional type with some ornament attached thereto, such as, for example, lantern lace shown in FIG. 7, crown lace shown in FIG. 8, wave lace shown in FIG. 9, etc. Thus, with those ornament designs, which can be made using conventional methods available in the art and it is unnecessary to further describe them here, the strap of the present invention can easily satisfy the demand for varieties and special aesthetical effects.

As described in the above, the soft-edged strap of the present invention is simple in structure, conducive to automation for increased production efficiency, and can be used in bra straps, girdles, and waistbands. The strap has soft edges and reduces the friction with the skin, thus producing less uncomfortable feel and red scratching marks on the skin. The spandex covered yarns used in the soft edge part and those used in the main body part are independently chosen from each other. Therefore no matter how thick the spandex covered yarns are employed in the strap's main body (for example, for the purpose of maintaining a good figure profile for females with fuller breasts), the edge of the strap will never feel coarse or produce a scratching feel on the skin. Furthermore, comparing with other methods known in the art, the soft edged strap of the present invention is produced in a single integral weaving process without requiring any follow-up procedures and thus can be manufactured cost effectively. Therefore, the underwear equipped with the strap of the present invention is smoother, more comfortable, and can meet the users' requirement for comfortableness, particularly for female users.

While there have been described and pointed out fundamental novel features of the invention as applied to a preferred embodiment thereof, it will be understood that various omissions and substitutions and changes, in the form and details of the embodiments illustrated, may be made by those skilled in the art without departing from the spirit of the invention. The invention is not limited by the embodiments described above which are presented as examples only but can be modified in various ways within the scope of protection defined by the appended patent claims.

What is claimed is:

1. A fabric strap for being used in underwear, comprising a main body and two longitudinal side edges of which at least one is a soft longitudinal side edge, wherein the two longitudinal side edges and the main body are integrally woven in a single weaving process and the soft longitudinal side edge is a non-hollow structure, has longer warp floats than the main body, and comprises spandex covered warp yarns that are of different thickness from those in the main body and are thinner to a degree sufficient for producing a softness effect.

2. The fabric strap according to claim 1, characterized in that the thickness of the spandex-covered warp yarns in the soft longitudinal side edge is in the range between 11 dtex and 310dtex.

3. The fabric strap according to claim 1, characterized in that the spandex-covered warp yarns in the soft edge are spandex filaments covered with other yarns such as nylon yarn, dacron through a Z twist- or S twist-process.

4. The fabric strap according to claim 1, characterized in that a plurality of weft yarns are not exposed on the warp yarn at the longitudinal side edge but are covered by the warp yarn at the longitudinal side edge for producing the effect of smoothness.

5. The fabric strap according to claim 1, characterized in that both longitudinal sides are soft edges which have thinner spandex-covered warp yarns than those in the main body and a majority of the weft yarns are not exposed on but instead covered by the warp yarn at each longitudinal side edge.

* * * * *